United States Patent [19]

Bourgeaux

[11] Patent Number: 4,544,000

[45] Date of Patent: Oct. 1, 1985

[54] SYNCHRONIZED ROTATING DOBBY FOR WEAVING LOOMS

[75] Inventor: Pierre F. X. Bourgeaux, La Balme de Sillingy, France

[73] Assignee: S. A. des Establissements Staubli (France), Fauerges, France

[21] Appl. No.: 573,280

[22] Filed: Jan. 24, 1984

[30] Foreign Application Priority Data

Feb. 7, 1983 [FR] France ..... 83 02271

[51] Int. Cl.[4] ..... D03C 1/00

[52] U.S. Cl. ..... 139/66 R; 139/76

[58] Field of Search ..... 139/66 R, 76, 68, 331, 139/74

[56] References Cited

U.S. PATENT DOCUMENTS 4,387,741 6/1983 Palau ..... 139/66 R 4,444,225 4/1984 Palau et al. ..... 139/66 R 4,461,325 7/1984 Palau et al. ..... 139/68

FOREIGN PATENT DOCUMENTS 315727 10/1971 U.S.S.R. ..... 139/68

*Primary Examiner*—James Kee Chi

*Attorney, Agent, or Firm*—Dowell & Dowell

[57] ABSTRACT

For the purpose of producing a synchronized rotating dobby capable of operating equally well in both directions of rotation, a plate fixed to a heddle-frame displacing eccentric is provided with a second notch diametrically opposite the immobilizing first notch in which engages the nose element of a pivoting lever actuated by the reading device. This second notch cooperates with the oppositely located lever to ensure maintenance of the correct positioning of the plate.

2 Claims, 6 Drawing Figures

SYNCHRONIZED ROTATING DOBBY FOR WEAVING LOOMS

The present invention relates to rotating dobbies for controlling the heddle frames mounted on weaving looms.

In rotating dobbies, the reciprocating vertical movement of the heddle frames is conventionally achieved by oscillating parts which may be constituted, depending on the case, by rod-lever assemblies or by roller-bearing levers, these oscillating parts being controlled by actuating elements (in the form of eccentrics in the first case, cams in the second) mounted on the main shaft of the mechanism. This shaft performs an intermittent movement of rotation and, every time it stops, i.e. every half-revolution of said shaft, at each of the blades of the dobby (i.e. the actuating unit associated with each heddle frame) and as a function of the design or weave to be obtained on the fabric being woven, the reading device must connect the actuating element either to said shaft in order to control the oscillating part or to a fixed point in order to effect angular immobilization of the latter.

Such selective connection is generally obtained with the aid of a mobile coupling mechanism in the form of a key or pawl, subjected to the action of two pivoting levers disposed on either side of the shaft in order to actuate said mobile mechanism in the two positions of stop thereof, each pair of pivoting levers being placed under the dependence of the reading device of the dobby.

Applicant's French Pat. No. 81 20502 of Oct. 29, 1981, and corresponding U.S. Pat. No. 4,444,225 proposes mounting the mobile coupling mechanism, preferably made in the form of a tilting pawl, on a plate laterally fixed to the corresponding actuating element, the pawl in question cooperating, under the effect of appropriate elastic means, with a drive disc fitted on the main shaft in order to allow coupling of this shaft with the actuating element and control of the corresponding heddle frame. Furthermore, elastic return means was provided to associate with each of the pivoting levers intended for actuating the mobile mechanism or pawl, said elastic return means tending to engage the end of these levers in a notch made in the above-mentioned lateral plate, such engagement ensuring angular immobilization of said plate and of the actuating element to which it is fixed, at the same time as the disengagement of the pawl.

Tests have shown that such an arrangement gave complete satisfaction in operation. However, as will be demonstrated hereinbelow in greater detail, it allows correct functioning only in one direction of rotation, whereas, for the pick-seeking and unweaving operations, it is necessary to be able to drive the dobby in reverse.

It is an object of the present invention to overcome this drawback and to produce a rotating dobby of the "synchronized" type, capable of operating equally well in forward and in reverse motion.

The invention will be more readily understood on reading the following description with reference to the accompanying drawings, in which.

Figure 1:
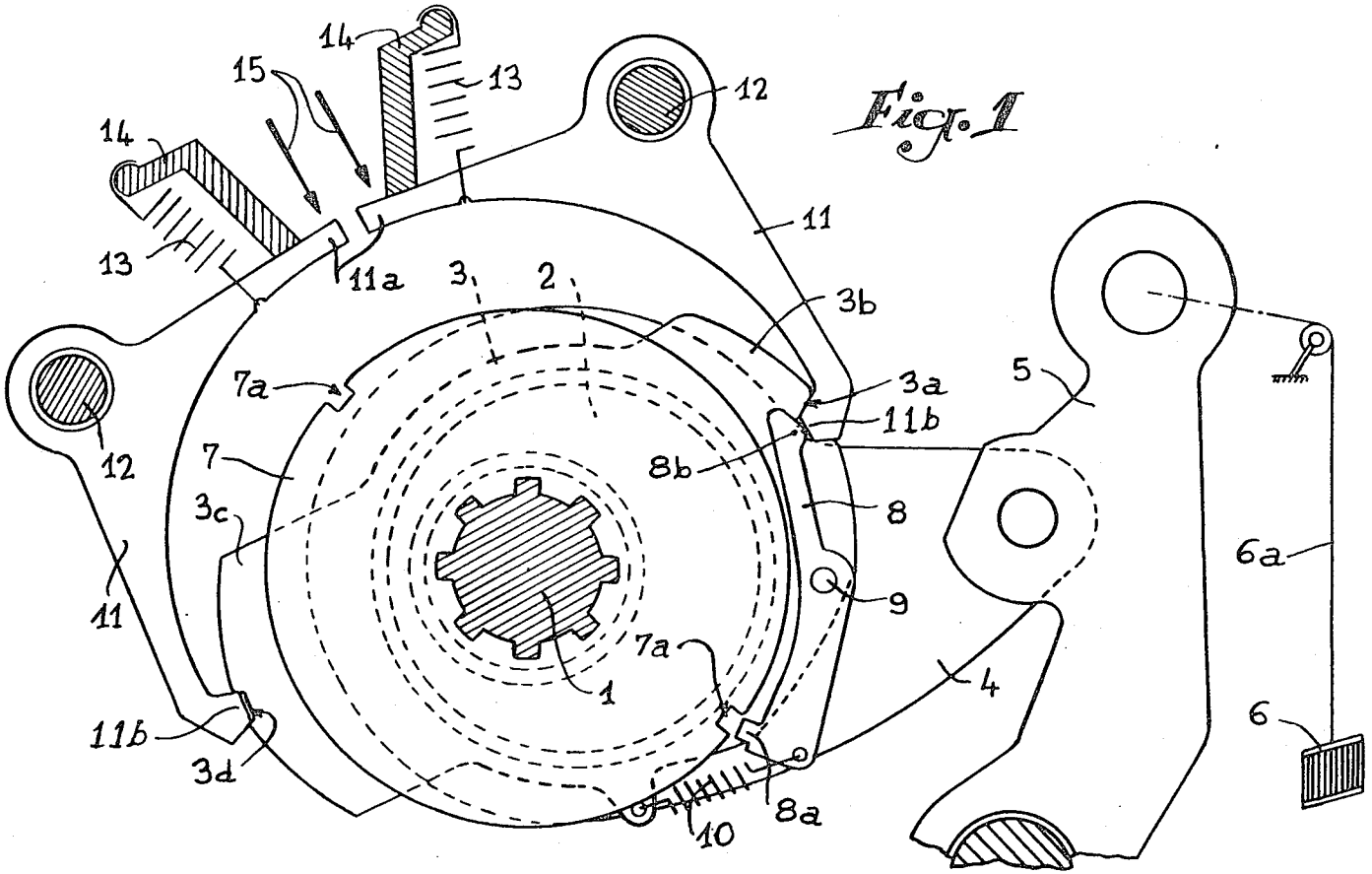
FIG. 1 is a schematic transverse section through a dobby according to the invention, this section showing the arrangement for actuating one of the blades of the dobby in question.

Referring now to the drawings, in the same manner as in FIG. 1 of the drawings of U.S. Pat. No. 4,444,225 mentioned hereinabove, FIG. 1 shows at 1 the main shaft of the dobby, driven by an intermittent movement of rotation with a stop every 180°. This shaft 1 receives a series of roller bearings, of number equal to that of the heddle frames of the loom, and on each roller bearing is idly mounted an eccentric 2 laterally fixed to a plate element 3. On each eccentric 2 is idly mounted the opening of a connecting rod 4 whose free end is coupled to a pivoting arm 5 which, through a cable 6*a*, causes vertical displacement of the heddle frame 6 of the blade in question. Between two contiguous eccentrics 2, the shaft 1, provided with teeth, bears a drive disc 7 which is fixed thereto and on whose periphery are cut two diametrically opposite radial drive notches 7*a*. These notches 7*a* are adapted to receive, selectively, the terminal finger 8*a* of a pawl 8 articulated on a pin 9 borne by the lateral plate 3 of the corresponding eccentric 2; a spring 10 tends permanently to return the finger 8*a* of the pawl 8 in the direction of shaft 1.

Control of each pawl 8 is achieved by two pivoting levers 11 pivotally borne by fixed pins 12 oriented parallel to shaft 1. Each lever 11 is in the form of a bracket and is biassed by a spring 13 to abut against a corresponding fixed stop 14. These two stops 14 thus define on each lever 11 an actuating tail 11*a*, adapted to be controlled by push elements (arrows 15) of the reading device of the dobby.

Opposite its tail 11*a*, each lever 11 presents a nose element 11*b*, diametrically opposite the similar nose element 11*b* of the other lever with respect to shaft 1; each nose element 11*b* is adapted to engage in an immobilizing notch 3*a* made radially in a projecting ramp or lug 3*b* of the plate 3. Opposite this notch 3*a*, the tilting pawl 8 borne by the plate in question comprises a terminal heel 8*b* adapted to actuate said pawl by contacting the nose element 11*b* engaged in said notch 3*a*.

The foregoing desription is vertually identical to that given in U.S. Pat. No. 4,444,225 mentioned above, with the result that it does not require detailed explanation as to the normal functioning of the dobby. It will suffice to recall that, in the absence of actuation of the push elements 15 of the reading device, the springs 13 tend, upon each stop of the plate 3 opposite the nose element 11*b* of one or the other of the two pivoting levers 11, to engage said nose element in the notch 3*a*, which has the simultaneous effect of angularly immobilize said plate (and with it, the eccentric 2 and the connecting rod 4) and also to cause disengagement of the pawl 8 by withdrawal of its finger 8*a* from the notch 7*a* in which it was introduced. On the other hand, when a lever 11 has its actuating tail depressed by a push element 15 against the spring 13 which is associated therewith, the pawl 8, under the action of spring 10, tends to engage its finger 8*a* in one or the other of the two notches 7*a* of the corresponding disc 7, thus ensuring coupling between said disc and the eccentric 2 and consequently effecting actuation of the connecting rod 4 and the heddle frame 6 during each rotation of shaft 1 through 180°.

Figure 2:
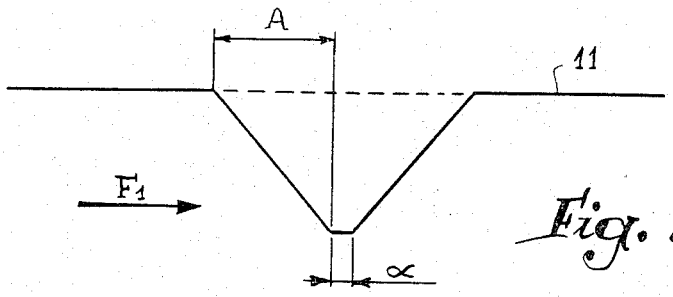
FIGS. 2, 3 and 4 are diagrams illustrating the displacement of the pivoting actuating levers, in forward motion, in reverse motion and in a synchronized dobby, respectively.

It should be observed here that, for the finger 8*a* to be engaged in a notch 7*a*, it is obviously indispensable to have a perfectly precise positioning of parts 7 and 8. Furthermore, it will be noted that, once this engagement is effected, the action of the push element 15 on the lever 11 must be maintained somewhat after the shaft has resumed its movement taking with it the disc 7 and the eccentric 2. In the diagram of FIG. 2, $F_1$ indicates the direction of rotation of shaft 1, 11 the relative displacement of the lever in question and A the stopping time of the rotation of shaft 1. It can therefore be observed that the nose element 11*b* of lever 11 remains disengaged from notch 3*a* for a short lapse of time $\alpha$ after the said shaft has resumed its rotation.

Figure 3:
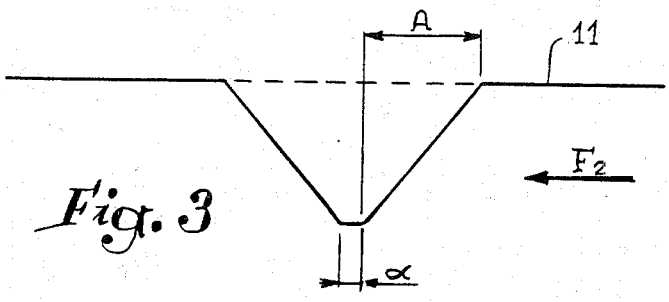
Figure 4:
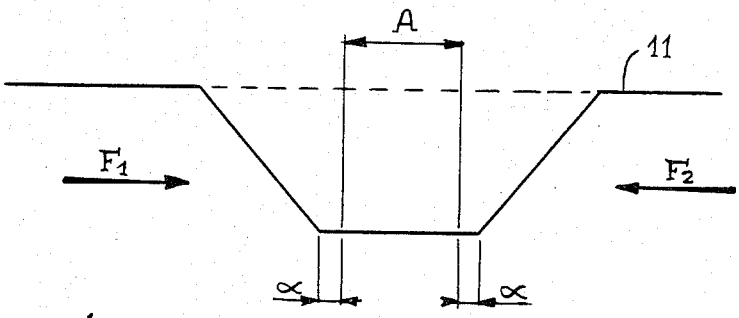

If it is now desired that shaft 1 and the whole of the dobby be capable of rotating in opposite direction $F_2$ (FIG. 3), the lapse of time $\alpha$ for maintaining the control of pawl 8 will be located on the opposite side from that shown in FIG. 2. However if it is intended to produce a synchronized mechanism adapted to operate equally well in both directions $F_1$ and $F_2$, two lapses of time $\alpha$ disposed on either side of the stop time A of shaft 1 must be provided, as illustrated in FIG. 4.

Now, if this arrangement were adopted in the case of the rotating dobby according to U.S. Pat. No. 4,444,225, the nose element 11*b* would be withdrawn from the notch 3*a* before the drive disc 7 is completely stopped. Under these conditions, the eccentric 2, under the effect of the vibrations inherent in the continuous rotation of parts 1 and 7, would risk off-setting angularly with respect to said parts, in which case one notch 7*a* would no longer be located in exact register with the finger 8*a* of the pawl 8. There would then be a defective selection.

To overcome this drawback and to allow a satisfactory synchronized rotating dobby to be produced in practice, the present invention consists in providing each of the plates 3 of the dobby with a projecting ramp or lug 3*c* provided opposite the ramp or lug 3*b* mentioned above, and in cutting in this second lug 3*c* a second notch 3*d* diametrically opposite immobilizing notch 3*a*.

Figure 6:
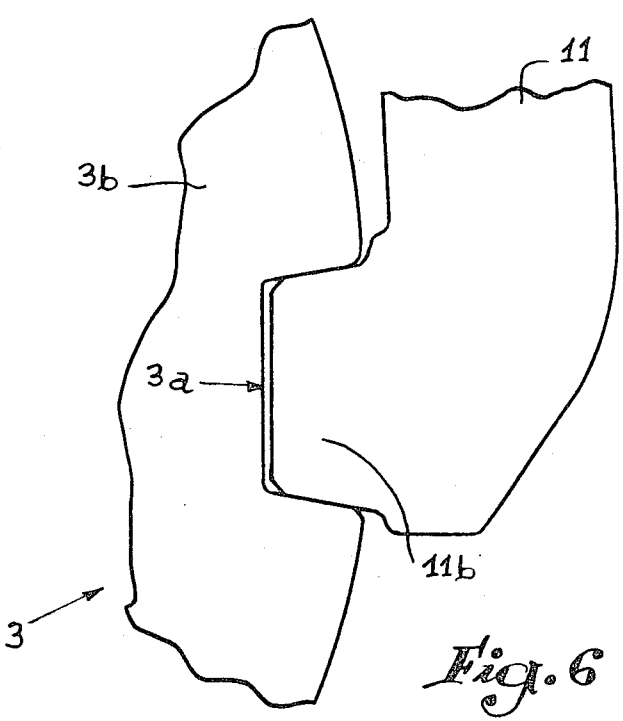
FIGS. 5 and 6 show on a larger scale the section of one and the other notch made on the periphery of one of the lateral plates of the dobby according to FIG. 1.
Figure 5:
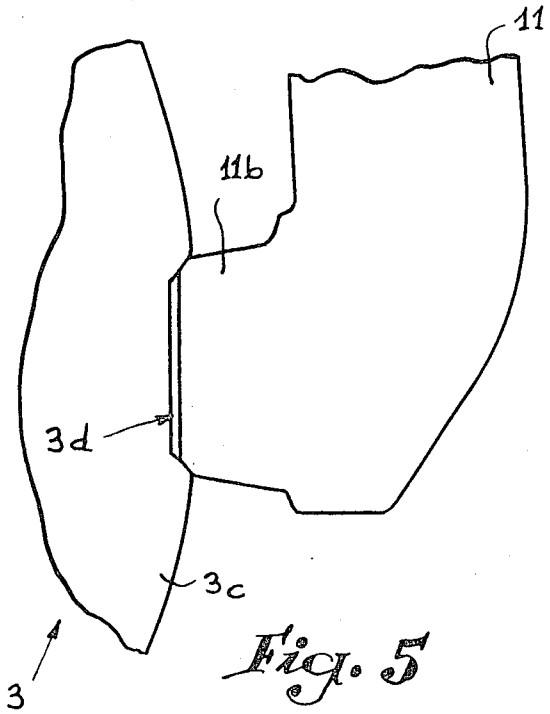

FIGS. 5 and 6 clearly show the profiles of the two notches 3*a* and 3*d* of the same plate 3 and it will be observed that the lateral walls of the notch 3*a*, relatively deep, are oriented parallel to the oblique sides of the nose element 11*b* to give a perfectly precise angular position to plate 3 and thus to ensure effective hold for as long as contact is maintained. However, the notch 3*d* is on the other hand cut to a smaller depth and comprises flared lateral walls, oriented parallel to the end bevels of the sides of the nose element 11*b*.

It will be understood that, under these conditions, cooperation of a nose element 11*b* with notch 3*d* holds the angular immobilization of the plate 3 during lapses of time $\alpha$, both in forward motion and in reverse. On the other hand, due to the flared section of notch 3*d*, the retaining action cannot oppose rotation of the plate, because nose element 11*b* is automatically ejected when said plate starts a new movement of rotation after stoppage.

The engagement of nose element 11*b* of one or the other of the two levers 11 of each blade in the corresponding notch 3*d* makes it possible to effect a second positioning of the eccentric 2 by the second lever 11, which positioning remains during lapse of time $\alpha$ and consequently avoids any risk of untimely angular offset. It will further be noted that since the release of pawl 8 occurs before stoppage A of shaft 1, said pawl has the whole period of this stoppage to penetrate its finger 8*a* into notch 7*a* so that very high operational speeds may thus be attained without risk of error.

It must, moreover, be understood that the foregoing description has been given only by way of example and that it in no way limits the domain of the invention which would not be exceeded by replacing the details of execution described by any other equivalents. In particular, the invention may be applied to dobbies in which the actuating elements are not constituted by eccentrics associated with connecting rods, but by cams sectioned to control roller-bearing levers coupled to the heddle frames 6. In the same way, and although the tilting pawls seem to be the most advantageous embodiment for the mobile coupling mechanism, radially displaced keys may, however, be employed.

What is claimed is:

1. An improved rotating dobby for a reversible weaving loom including a shaft which rotates intermittently through 180° and including an actuating rod for each heddle frame and including a pattern reading mechanism, and the dobby being of the type having a drive disc associated with each actuating rod and fixed to rotate with the shaft and having diametrically opposed drive notches, and the dobby having a plate member journaled on the shaft and fixed to eccentric means operative to reciprocate the actuating rod when the plate member rotates, said plate member having an immobilizing notch on its outer periphery and having a pivot which supports pawl means including a first end having a finger which is spring urged to engage a drive notch of the drive disc to couple the plate member to the drive disc and including a heel portion disposed adjacent said immobilizing notch and displaceable to disengage the finger from a drive notch, and the dobby having paired levers supported on fixed pivots and having noses extending toward diametrically opposite sides of the plate member and the noses normally being spring urged to enter a notch in the plate member and immobilize the plate member and displace the heel portion of the pawl, and said reading mechanism being operative selectively to pivot the levers to move their noses away from said plate member, the improvement comprising:

a second notch in the plate member which is disposed diametrically opposite said immobilizing notch and so located with respect to said pair levers that when the immobilizing notch is disposed at an angle of plate rotation to receive the nose of one of said levers, said second notch is disposed at an angle of plate rotation to receive the nose of the other of said levers.

2. The rotating dobby as claimed in claim 1, wherein said second notch is of lesser depth in the plate member than the immobilizing notch and has lateral walls which are flared to eject the nose of a lever automatically when the plate member is positively rotated by the drive disc.

* * * * *